US006878650B2

(12) United States Patent
Clark et al.

(10) Patent No.: US 6,878,650 B2
(45) Date of Patent: Apr. 12, 2005

(54) FINE DENIER MULTICOMPONENT FIBERS

(75) Inventors: Darryl Franklin Clark, Alpharetta, GA (US); Justin Max Duellman, Little Rock, AR (US); Bryan David Haynes, Cumming, GA (US); Jeffrey Lawrence McManus, Canton, GA (US); Kevin Edward Smith, Highlands Ranch, CO (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 355 days.

(21) Appl. No.: 09/742,830

(22) Filed: Dec. 20, 2000

(65) Prior Publication Data

US 2002/0009941 A1 Jan. 24, 2002

Related U.S. Application Data

(60) Provisional application No. 60/171,320, filed on Dec. 21, 1999.

(51) Int. Cl.[7] ..... D04H 1/00; D04H 13/00; D04H 3/16

(52) U.S. Cl. ..... 442/340; 442/361; 442/364; 442/401

(58) Field of Search ..... 442/340, 361, 442/401, 364

(56) References Cited

U.S. PATENT DOCUMENTS

| | | | |
|---|---|---|---|
| 3,423,266 | A | 1/1969 | Davies et al. |
| 3,595,731 | A | 7/1971 | Davies et al. |
| 3,802,817 | A | 4/1974 | Matsuki et al. |
| 4,189,338 | A | 2/1980 | Ejima et al. |
| 4,211,816 | A | 7/1980 | Booker et al. |
| 4,234,655 | A | 11/1980 | Kunimune et al. |
| 4,269,888 | A | 5/1981 | Ejima et al. |
| 4,285,748 | A | 8/1981 | Booker et al. |
| 4,323,626 | A | 4/1982 | Kunimune et al. |
| 4,361,609 | A | 11/1982 | Gerlach et al. |
| 4,381,274 | A | 4/1983 | Kessler et al. |
| 4,451,589 | A | 5/1984 | Morman et al. |
| 4,469,540 | A | 9/1984 | Furukawa et al. |

(Continued)

FOREIGN PATENT DOCUMENTS

| | | |
|---|---|---|
| DE | 74 637 | 7/1970 |
| EP | 0089113 | 9/1983 |

(Continued)

OTHER PUBLICATIONS

ASTM Designation: D 1238–95; Standard Test Method for Flow Rates of Thermoplastics by Extrusion Plastometer.

*Primary Examiner*—Deborah Jones
*Assistant Examiner*—Christopher C Pratt
(74) *Attorney, Agent, or Firm*—William D. Herrick

(57) ABSTRACT

A method is provided for producing fine denier multicomponent thermoplastic polymer filaments incorporating high melt-flow rate polymers. Multicomponent filaments are extruded such that the high melt-flow rate polymer component is substantially surrounded by one or more low melt-flow rate polymer components. The extruded multicomponent filament is then melt-attenuated with a significant drawing force to reduce the filament diameter and form continuous, fine denier filaments.

11 Claims, 2 Drawing Sheets

U.S. PATENT DOCUMENTS 4,477,516 A 10/1984 Sugihara et al.
4,500,384 A 2/1985 Tomioka et al.
4,555,430 A 11/1985 Mays
4,563,392 A 1/1986 Harpell et al.
4,632,858 A 12/1986 Knoke et al.
4,652,484 A 3/1987 Shiba et al.
4,657,804 A 4/1987 Mays et al.
4,681,801 A 7/1987 Eian et al.
4,684,570 A 8/1987 Malaney
4,738,895 A 4/1988 Takada et al.
4,756,786 A 7/1988 Malaney
4,766,029 A 8/1988 Brock et al.
4,814,032 A 3/1989 Taniguchi et al.
4,818,587 A 4/1989 Ejima et al.
4,830,904 A 5/1989 Gessner et al.
4,840,846 A 6/1989 Ejima et al.
4,851,284 A 7/1989 Yamanoi et al.
4,861,633 A 8/1989 Abe
4,874,666 A 10/1989 Kubo et al.
4,883,707 A 11/1989 Newkirk
4,997,611 A 3/1991 Hartmann
5,082,720 A 1/1992 Hayes
5,108,820 A 4/1992 Kaneko et al.
5,133,917 A 7/1992 Jezic et al.
5,143,779 A 9/1992 Newkirk et al.
5,213,881 A 5/1993 Timmons et al.
5,246,772 A 9/1993 Manning
5,272,023 A 12/1993 Yamamoto et al.
5,277,974 A 1/1994 Kubo et al.
5,277,976 A 1/1994 Hogle et al.
5,284,704 A 2/1994 Kochesky et al.
5,382,400 A 1/1995 Pike et al.
5,411,693 A 5/1995 Wust, Jr.
5,418,045 A 5/1995 Pike et al.
5,456,982 A 10/1995 Hansen et al.
5,466,410 A 11/1995 Hills
5,484,645 A 1/1996 Lickfield et al.
5,487,943 A 1/1996 Kozulla
5,498,468 A 3/1996 Blaney
5,503,907 A 4/1996 Gessner et al.
5,534,340 A 7/1996 Gupta et al.
5,540,979 A 7/1996 Yahiaoui et al.
5,540,992 A 7/1996 Marcher et al.
5,545,464 A 8/1996 Stokes
5,554,435 A 9/1996 Gupta et al.
5,554,437 A 9/1996 Gupta et al.
5,556,589 A 9/1996 Sibal
5,622,772 A 4/1997 Stokes et al.
5,633,082 A 5/1997 Berger
5,635,290 A 6/1997 Stopper et al.
5,645,057 A 7/1997 Watt et al.
5,662,728 A 9/1997 Groeger
5,667,864 A 9/1997 Landoll
5,672,415 A 9/1997 Sawyer et al.
5,681,646 A 10/1997 Ofosu et al.
5,691,029 A 11/1997 Lucas
5,728,299 A 3/1998 Tokudome et al.
5,733,635 A 3/1998 Terakawa et al.
5,733,822 A 3/1998 Gessner et al.
5,759,926 A * 6/1998 Pike et al. ..... 442/333
5,773,120 A 6/1998 Deka et al.
5,780,155 A 7/1998 Ishizawa et al.
5,798,305 A 8/1998 Horiuchi
5,800,230 A 9/1998 Horiuchi et al.
5,804,286 A 9/1998 Quantrille et al.
5,804,517 A 9/1998 Ishii et al.
5,807,490 A 9/1998 Davis et al.
5,811,045 A 9/1998 Pike
5,817,584 A 10/1998 Singer et al.
5,910,362 A 6/1999 Aratake et al.
5,935,883 A * 8/1999 Pike ..... 442/340
5,993,714 A 11/1999 Sawyer et al.
6,420,285 B1 * 7/2002 Newkirk et al. ..... 442/364

FOREIGN PATENT DOCUMENTS

EP 0132110 A2 1/1985
EP 0264112 A2 4/1988
EP 0277707 B1 8/1988
EP 0421734 B1 4/1991
EP 0691427 A1 1/1996
GB 2121423 A 4/1983
JP 45-3291 2/1970
JP 45-18727 6/1970
JP 47-24167 7/1972
JP 47-37651 9/1972
JP 53-086836 7/1978
JP 56-015417 2/1981
JP 59-173312 10/1984
JP 60-21908 2/1985
JP 60-215834 10/1985
JP 62-184118 8/1987
JP 62-299514 12/1987
JP 63-105111 5/1988
JP 01-020322 1/1989
JP 01-118618 5/1989
JP 01-229856 9/1989
JP 02-133614 5/1990
JP 02-139649 5/1990
JP 02-191716 7/1990
JP 02-191717 7/1990
JP 02-191718 7/1990
JP 02-251612 10/1990
JP 03-18309 1/1991
JP 03-64519 3/1991
JP 03-130013 6/1991
JP 03-137223 6/1991
JP 03-167314 7/1991
JP 03-185115 8/1991
JP 03-241054 10/1991
JP 03-241055 10/1991
JP 03-287818 12/1991
JP 03-287848 12/1991
JP 04-41290 2/1992
JP 04-41762 2/1992
JP 04-45824 2/1992
JP 04-45825 2/1992
JP 04-126585 4/1992
JP 04-163315 6/1992
JP 04-281014 10/1992
JP 05-009809 1/1993
JP 05-59614 3/1993
JP 06-158499 6/1994
JP 06-184822 7/1994
JP 08-074128 3/1996
JP 09-105060 4/1997
JP 09-209254 8/1997
JP 10-088460 4/1998
WO 89/10989 11/1989
WO 97/36038 A1 10/1997
WO 97/37071 A1 10/1997
WO 98/12370 3/1998
WO 98/18616 5/1998
WO 98/29587 7/1998

* cited by examiner

FINE DENIER MULTICOMPONENT FIBERS

This application claims the benefit of Provisional application No. 60/171,320 filed Dec. 21, 1999.

FIELD OF THE INVENTION

The present invention relates to multicomponent thermoplastic polymer filaments and methods of making the same.

BACKGROUND OF THE INVENTION

The production of multicomponent thermoplastic fibers and filaments has been known in the art for some time. The term "multicomponent" generally refers to fibers that have been formed from at least two polymer streams which have been brought together to form a single, unitary fiber. Typically the separate polymer streams are brought together just prior to or immediately after extrusion of the molten polymer to form filaments. The polymer streams are brought together and each forms a distinct component arranged in substantially constantly positioned distinct zones across the cross-section of the fiber. In addition, the distinct components also extend substantially continuously along the length of the fiber. The configuration of such fibers can vary and commonly the individual components of the fiber are positioned in a side-by-side arrangement, in a sheath/core arrangement, in a pie arrangement, an islands-in-sea arrangement or other configuration. As but a few examples, multicomponent filaments and methods of making the same are described in U.S. Pat. No. 5,108,820 to Kaneko et al., U.S. Pat. No. 5,382,400 to Pike et al., U.S. Pat. No. 5,277,976 to Hogle et al., U.S. Pat. No. 5,466,410 to Hills and U.S. Pat. Nos. 3,423,266 and 3,595,731 both to Davies et al. Multicomponent fibers offer various advantages such as the ability to form fabrics having fiber crimp, autogenous bonding, good hand and/or other desirable characteristics. Thus, multicomponent spunbond fibers have found useful applications, both alone and in laminate structures, in personal care articles, filter materials, industrial and personal wipers, medical fabrics, protective fabrics and so forth.

Typically, the multicomponent fibers are made from two different polymers such as, for example, polypropylene and polyethylene, polyethylene and nylon, polyethylene and PET and so forth. As described in U.S. Pat. No. 5,382,400 to Pike et al., by Employing polymers having considerably different melting points it is possible to bond the fabrics made therefrom by through-air bonding. The low melting component can be sufficiently heated so as to form bonds at fiber contact points whereas the high melting component retains the integrity of both the fiber structure and the structure of the fabric. The differences in melting points can also be used to form a helical crimp within the multicomponent fibers. As a further example, U.S. Pat. No. 4,323,626 to Kunimune et al. teaches fine multicomponent fibers having a thin adhesive component having a uniform thickness. The fibers of Kunimune comprise a first polypropylene component having a melt-flow rate between 1–50 g/10 minutes and a second ethylene-vinyl acetate component having a melt-index of 1–50 g/10 minutes. The second component comprises a portion of the outer surface of the fibers and can have a higher melt-index than the melt-flow rate of the first polypropylene component. However, Kunimune et al. teaches that use of the second component should not vary outside the melt-index range of 1–50 g/10 minutes since decomposition during the spinning process otherwise occurs. As taught in Kunimune, conventional practice has been to utilize polymeric components with similar melt-flow rates. Additionally, conventional practice also typically employs polymers having lower melt-flow rates since utilization of polymers with higher melt-flow rates or disparate melt-flow rates can often cause filaments to break or otherwise decompose during melt-attenuation steps.

However, relatively higher melt-flow rate polymers have been successfully utilized heretofore in spinning fine denier thermoplastic polymer fibers. U.S. Pat. No. 5,681,646 to Ofosu et al. teaches that high melt-flow rate polymers, such as polypropylene having a MFR of between about 50 and 150 g/10 minutes, can be used to make high strength fibers. In addition, use of such high melt-flow rate polymers is also taught in U.S. Pat. No. 5,672,415 to Sawyer et al. More particularly, Sawyer et al. teaches a multicomponent fiber having a first ethylene polymer component having a melt-index between 60–400 g/10 minutes and a second propylene polymer component having a melt-flow rate between 50–800 g/10 minutes. Use of the relatively high melt-flow rate polymers provides fine fibers, enhances crimp and also improves certain aspects of the spinning process. However, while relatively higher melt-flow rate polymers are taught in Sawyer et al., the examples of Sawyer et al. employ polymeric components having relatively similar melt-flow rates. Use of disparate melt-flow rates would be expected to create problems in the spinning and/or melt-attenuation steps such as, for example, fiber breakage.

An increasing variety of high melt-flow rate polymers are being developed as a result of current improvements in polymerization processes and catalysts. Notably, the use of metallocene and/or constrained geometry catalysts used in the production of olefin polymers has provided an ever increasing variety of polymers with distinct physical and/or rheological properties. In particular, high melt-flow rate polymers suitable for spinning are becoming more widely available. However, fiber production processes that require a melt-attenuation step as a means for molecularly orienting the polymer and/or reducing the fiber diameter have an inherent limitation with regard to the usefulness of such high melt-flow rate polymers. As the melt-flow rate increases, the amount of attenuating force that may be applied to the molten filament decreases since the higher melt-flow rate polymers have a lower melt viscosity and are therefore more prone to break at lower attenuating forces. Thus, there exists a need for methods of producing fibers that are capable of utilizing high melt-flow rate polymers and further which are capable of adequately melt-attenuating the same.

SUMMARY OF THE INVENTION

The aforesaid needs are fulfilled and the problems experienced by those skilled in the art overcome by a method of the present invention, comprising the steps of (i) extruding a first molten thermoplastic polymer and a second molten thermoplastic polymer and forming a unitary multicomponent thermoplastic polymer filament, and (ii) melt-attenuating the filament with a drawing force of at least 3 psig and/or reducing the diameter of the extruded filament by at least about 75%. In addition, the first thermoplastic polymer desirably has a melt-flow rate at least three times (3×) that of the second thermoplastic polymer component and, further, the second thermoplastic polymer component desirably comprises a major portion of the outer surface of the filament.

In a further aspect, a nonwoven web of the present invention can comprise a web of multicomponent fibers wherein the multicomponent fibers comprise a first polymeric component and a second polymeric component wherein the first polymeric component comprises a first polymer having a melt flow rate and wherein the second component comprises a major portion of the outer surface of the fiber and comprises a second polymer having a melt-flow rate at least 65% less than that of the first polymer. As an example, for spunbonding processes, the first polymer can comprise polypropylene having a melt-flow rate in excess of about 200 g/10 minutes and the second polymer can comprise a melt-flow rate less than about 50 g/10 minutes. As a further example, for meltblowing processes, the first polymer can comprise polypropylene having a melt-flow rate in excess of about 1000 g/10 minutes and the second polymer can comprise a melt-flow rate less than about 350 g/10 minutes.

DEFINITIONS

As used herein and in the claims, the term "comprising" is inclusive or open-ended and does not exclude additional unrecited elements, compositional components, or method steps.

As used herein the term "nonwoven" fabric or web means a web having a structure of individual fibers or threads which are interlaid, but not in an identifiable manner as in a knitted or woven fabric. Nonwoven fabrics or webs can be formed by various processes such as, for example, meltblowing processes, spunbonding processes, hydroentangling, air-laid and bonded carded web processes.

Unless otherwise specifically limited, as used herein the term "polymer" includes, but is not limited to, homopolymers, copolymers, such as for example, block, graft, random and alternating copolymers, terpolymers, etc. and blends and modifications thereof. Furthermore, unless otherwise specifically limited, the term "polymer" includes all possible spatial configurations of the molecule. These configurations include, but are not limited to isotactic, syndiotactic and random symmetries.

As used herein the term "melt-flow rate" or "MFR" means the melt-flow rate of the polymer prior to extrusion and as measured in accord with ASTM D1238-90b condition 2.16. The particular temperature at which the MFR is measured will vary in accord with the polymer composition as described in the aforesaid ASTM test. As particular examples, propylene polymers are measured under conditions 230/2.16 and ethylene polymers measured under conditions 190/2.16.

DETAILED DESCRIPTION OF THE INVENTION

Figure 1:
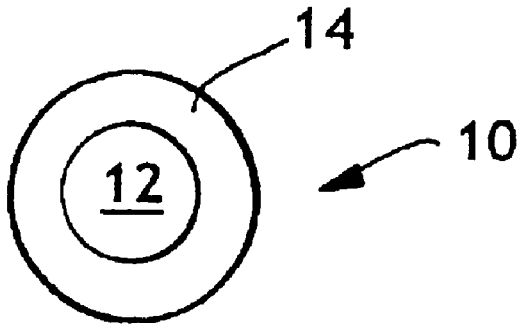
FIGS. 1 through 3 are drawings of cross-sectional configurations of multicomponent fibers suitable for use with the present invention.
Figure 2:
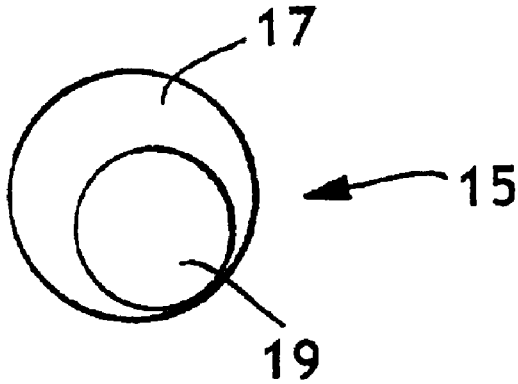
Figure 3:
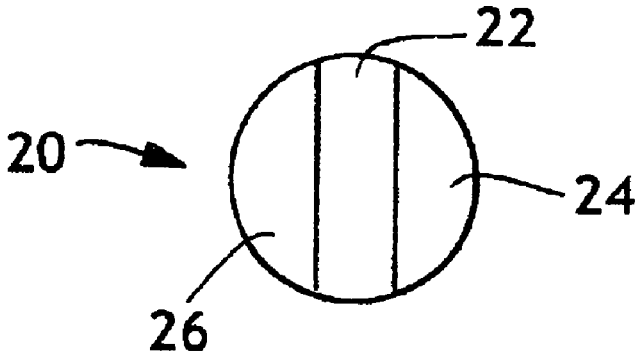

In practicing the present invention, multicomponent fibers are formed and then melt-attenuated, with or without additional heat, such that the continuous multicomponent fibers are drawn and the diameter of the fibers reduced. Desirably, the multicomponent polymeric filaments comprise at least first and second polymeric components wherein the first polymeric component has a higher melt-flow rate (MFR) than the second polymeric component and further wherein the second polymeric component comprises a majority of the outer portion of the multicomponent filament. As an example, and in reference to FIG. 1, bicomponent filament 10 has a sheath/core configuration and comprises first polymeric component 12 of a first polymer and second polymeric component 14 of a second polymer. Second polymeric component 14, i.e. the sheath component, comprises 100% of the outer surface of multicomponent filament 10. While not fully revealed by the fiber cross-section view, first and second components 12 and 14 are arranged in substantially distinct zones across the cross-section of the bicomponent filament extending substantially continuously along the length of the bicomponent filament. Desirably, the second component comprises a majority (i.e. more than 50%) of the outer surface of the filament and more desirably comprises greater than about 65% of the outer surface of the filament and still more desirably comprises greater than 85% of the outer surface of the filament. As a further example, and in reference to FIG. 2, the first component 19 and second component 17 of multicomponent filament 15 can be arranged in an eccentric sheath/core arrangement wherein second component 17 forms a major portion and first component 19 forms a minor portion of the exterior surface of filament 15. In a further aspect, and in reference to FIG. 3, multicomponent filament 20 comprises first polymer component 22 comprising a first polymer and second and third polymer components 24 and 26. Second and third polymer components 24 and 26 can comprise the same or different polymer and have similar MFRs that are less than that of the first polymer. Further, second and third components 24 and 26 collectively form the majority of the outer surface of filament 20. Numerous other multicomponent configurations are suitable for use with the present invention. In this regard, although the particular process described herein is primarily with respect to bicomponent filaments, the process of the present invention and materials made therefrom are not limited to such bicomponent structures and other multicomponent configurations, for example configurations using more than two polymers and/or more than two components, are intended to be encompassed by the present invention. In addition, the multicomponent filaments can have other than round cross-sectional shapes.

The volume ratio of the high and low MFR components will vary with regard to various factors including, but not limited to, the cross-sectional configuration, the degree of attenuating force intended to be applied, the disparity in MFRs and/or viscosities, the respective polymer compositions and so forth. Desirably, the high MFR polymeric component comprises between about 10% and about 65%, by volume, of the multicomponent filament and still more desirably comprises between about 20% and about 60%, by volume, of the multicomponent filament. As an example of a specific embodiment for bicomponent filaments, the first or high MFR component comprises between about 30% and about 50%, by volume, of the filament cross-section and the second or low MFR component desirably comprises between about 50% and about 70%, by volume, of the filament cross-section. Generally speaking, by utilizing higher percentage of a lower MFR component it is possible to use polymers with very high melt-flow rates within the first component and/or first and second polymers having a greater MFR disparity.

As the viscosity of a polymer decreases the MFR increases. In this regard as the viscosity of the polymer decreases there is generally a reduction in the ability to melt-attenuate the extruded filaments, i.e. "pull" the extruded filament, and orient the polymer and/or reduce the overall filament diameter. With many lower viscosity polymers the viscosity is such that fiber breakage or atomization occurs with the application of any significant attenuating force. Thus, there is an inherent limitation on the use of low viscosity and/or high MFR polymers in any process employing a melt-attenuating step. However, by employing polymers in the configurations described above it is possible to produce fine filaments from high MFR polymers utilizing melt-attenuating steps. While not wanting to be limited by any particular theory, it is believed that the high viscosity or low MFR polymer, which comprises a majority of the outer surface of the extruded filament, quickly skins over and provides the extruded filament with sufficient integrity to allow the application of a significant attenuating force without breaking or atomizing the extruded filament. Further, it is believed that the latent heat within the molten high MFR polymer, which comprises a minor portion of the outer surface of the filament, also helps maintain at least a portion of the low MFR polymer in a molten or semi-molten state thereby further improving the effects of the melt-attenuation steps. Thus, the disparity in MFRs and/or viscosities is believed advantageous to forming fine denier filaments as well as nonwoven webs having improved coverage and fabric uniformity.

With regard to spunbond or melt-spun processes, the first polymeric component (the high MFR component) desirably comprises a first polymer having a melt-flow rate in excess of 150 g/10 minutes and even still more desirably a melt-flow rate in excess of about 250 g/10 minutes and even still more desirably in excess of about 500 g/10 minutes. Additionally, the second component (the lower MFR component), comprising a major portion of the outer surface of the filament, comprises a second polymer having a melt-flow rate at least 65% less than that of the first polymer. Further, the second polymer can have an MFR at least 75% less than that of the MFR of the first polymer and even at least 85% less than the MFR of the first polymer. As a specific example, the first polymer may comprise polypropylene having a melt-flow rate in excess of about 150 g/10 minutes and the second polymer may comprise a melt-flow rate less than about 55 g/10 minutes and, as a further example, the first polymer may comprise polypropylene having a melt-flow rate in excess of about 200 g/10 minutes and the second polymer may comprise a melt-flow rate less than about 50 g/10 minutes.

With regard to meltblowing or similar blown processes, the first polymeric component (the high MFR component) desirably comprises a first polymer having a melt-flow rate in excess of 800 g/10 minutes and still more desirably a melt-flow rate in excess of 1000 g/10 minutes and still more desirably in excess of 1200 g/10 minutes. Additionally, the second component (the lower MFR component), comprising a major portion of the outer surface of the filament, comprises a second polymer having a melt-flow rate at least 65% less than that of the first polymer. Further, the second polymer can have an MFR at least 75% less than that of the MFR of the first polymer and even at least 85%, less than the MFR of the first polymer. As a specific example, the first polymer may comprise polypropylene having a melt-flow rate of about 1000 g/10 minutes or more and the second polymer may comprise a melt-flow rate less of about 350 g/10 minutes or less. As a further example, first polymer may comprise polypropylene having a melt-flow rate of about 1200 g/10 minutes or more and the second polymer may comprise a melt-flow rate of about 400 g/10 minutes or less.

Polymers suitable for use in the present invention include, but are not limited to, polyolefins (e.g., polypropylene and polyethylene), polycondensates (e.g., polyamides, polyesters, polycarbonates, and polyacrylates), polyols, polydienes, polyurethanes, polyethers, polyacrylates, polyacetals, polyimides, cellulose esters, polystyrenes, fluoropolymers, and polyphenylenesulfide and so forth. In a particular embodiment, each component of the multicomponent filament comprises polymers selected from the group consisting of alpha-olefins, poly(1-butene), poly(2-butene), poly(1-pentene), poly(2-pentene), poly(1-methyl-1-pentene), poly(3-methyl-1-pentene), and poly(4-methyl-1-pentene) and the like. Still more desirably, each component can be selected from the group consisting of ethylene polymers, propylene polymers, ethylene/propylene copolymers, and copolymers of ethylene or propylene with other alpha-olefins. As specific examples thereof, the polymeric components can comprise HDPE/PP(high MFR), LLDPE/PP(high MFR), PP(low MFR)/PP(high MFR), PE/Nylon and so forth.

Low melt-flow rate polymers suitable for spinning are known in the art and are commercially available from a variety of vendors. Exemplary low MFR polymers include, but are not limited to, ESCORENE polypropylene available from the Exxon Chemical Company of Houston, Tex. and 6811A polyethylene available from the Dow Chemical Company. High MFR polymers can be catalyzed and/or produced by various methods known in the art. As an example, high MFR polyolefins may be achieved when starting with a conventional low melt-flow polyolefin through the action of free radicals which degrade the polymer to increase melt-flow rate. Such free radicals can be created and/or rendered more stable through the use of a pro-degradant such as peroxide, an organo-metallic compound or a transition metal oxide. Depending on the pro-degradant chosen, stabilizers may be useful. One example of a way to make a high melt-flow polyolefin from a conventional low melt-flow polyolefin is to incorporate a peroxide into the polymer. Peroxide addition to polymers is taught in U.S. Pat. No. 5,213,881 to Timmons et al. and peroxide addition to polymer pellets is described in U.S. Pat. No. 4,451,589 to Morman et al., the entire contents of each of the aforesaid references are incorporated herein by reference. Peroxide addition to a polymer for spunbonding applications can be done by adding up to 1000 ppm of peroxide to commercially available low melt-flow rate polyolefin polymer and mixing thoroughly. The resulting modified polymer will have a melt-flow rate of approximately two to three times that of the starting polymer, depending upon the rate of peroxide addition and mixing time. In addition, suitable high MFR polymers can comprise polymers having a narrow molecular weight distribution and/or low polydispersity (relative to conventional olefin polymers such as those made by Ziegler-Natta catalysts) and include those catalyzed by "metallocene catalysts", "single-site catalysts", "constrained geometry catalysts" and/or other like catalysts. Examples of such catalysts and/or olefin polymers made therefrom are described in, by way of example only, U.S. Pat. No. 5,153,157 to Canich, U.S. Pat. No. 5,064,802 to Stevens et al., U.S. Pat. 5,374,696 to Rosen et al. U.S. Pat. No. 5,451,450 to Erderly et al.; U.S. Pat. No. 5,204,429 to Kaminsky et al,; U.S. Pat. No. 5,539,124 to Etherton et al., U.S. Pat. Nos. 5,278,272 and 5,272,236, both to Lai et al., U.S. Pat. No. 5,554,775 to Krishnamurti et al. and U.S. Pat. No. 5,539,124 to Etherton et al. Examples of suitable commercially available polymers having a high MFR include, but are not limited to, 3746G polypropylene (1100 MFR) from Exxon Chemical Company, 3505 polypropylene (400 MFR) from Exxon Chemical Company and PF015 polypropylene (800 MFR) from Montell Polyolefins.

Figure 4:
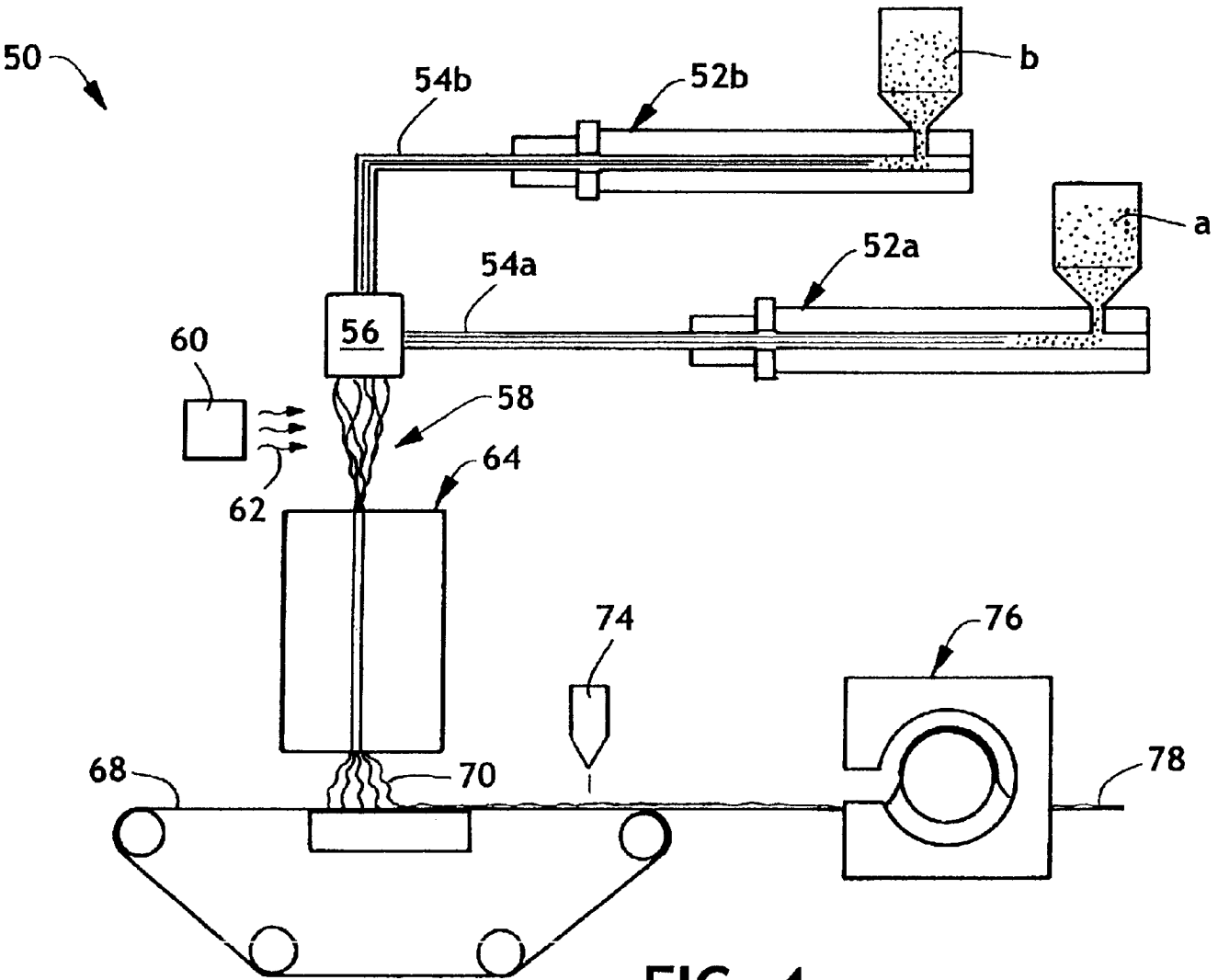
FIG. 4 is a schematic drawing of a fiber draw unit and spinning line suitable for practicing present invention.

The filaments of the present invention are made via a process wherein the filaments are attenuated in a molten or semi-molten state, i.e. melt-attenuated. The filaments can be drawn and/or attenuated by various means known in the art. As an example and in reference to FIG. 4, polymers A and B can be fed from extruders 52*a* and 52*b* through respective polymer conduits 54*a* and 54*b* to spin pack assembly 56. Spin packs assemblies are known to those of ordinary skill in the art and thus are not described here in detail, however exemplary spin pack assemblies are described in U.S. Pat. No. 5,344,297 to Hills and U.S. Pat. No. 5,989,004 Cook, the entire contents of each of the aforesaid references are incorporated herein by reference. Generally described, a spin pack assembly can include a housing and a plurality of distribution plates stacked one on top of the other with a pattern of openings arranged to create flow paths for directing polymer components A and B separately through the spin pack assembly. The distribution plates are coupled to a spin plate or spinneret which typically has a plurality of openings which are commonly arranged in one or more rows. For the purposes of the present invention, spin pack assembly 56 can be selected to form multicomponent filaments of a desired size, shape, cross-sectional configuration and so forth. A downwardly extending curtain of filaments 58 can be formed when the molten polymers are extruded through the openings of the spinneret. The polymer streams can be brought together either before extrusion or immediately thereafter to form a unitary multicomponent filament. The spin pack is maintained at a sufficiently high temperature to maintain polymers A and B in a molten state at the desired viscosity. As an example, with polyethylene and/or polypropylene polymers the spin pack temperature is desirably maintained at temperatures between about 400° F. (204° C.) and about 500° F. (260° C.).

The process line 50 can also include one or more quench blowers 60 positioned adjacent the curtain of extruded filaments 58 extending from the spin pack assembly 56. Fumes and air heated from the high temperature of the molten polymer exiting the spin plate, can be collected by vacuum (not shown) while quench air 62 from blower 60 quenches the, just extruded, molten filaments 58. Quench air 60 can be directed from one side of the filament curtain or from both sides of the filament curtain as desired. As used herein, the term "quench" simply means reducing the temperature of the filaments using a medium that is cooler than the filaments such as, for example, ambient air. The filaments are desirably sufficiently quenched to prevent their sticking to the draw unit. In this regard, quenching of the filaments can be an active step (e.g. purposefully directing a stream of cooler air across the filaments) or a passive step (e.g. simply allowing ambient air to cool the molten filaments).

Fiber draw unit 64, positioned below the spin pack assembly 56 and quench blower 60, receives the partially quenched filaments. Fiber draw units for use in melt spinning polymers are well known in the art. Suitable fiber draw units for use in the process of the present invention include, by way of example only, a linear fiber aspirator of the type shown in U.S. Pat. No. 3,802,817 to Matsuki et al. and eductive guns of the type shown in U.S. Pat. No. 3,692,618 to Dorschner et al. and U.S. Pat. No. 3,423,266 to Davis et al., the entire contents of the aforesaid references are incorporated herein by reference.

Generally described, an exemplary fiber draw unit 64 can include an elongate vertical passage through which the filaments are drawn by aspirating air entering from the sides of the passage and flowing downwardly through the passage. The temperature of the aspirating air can be cooler than that of the filaments, e.g. ambient air, or it can be heated as desired to impart the desired characteristics to the filaments, e.g. crimp and so forth. A blower (not shown) can supply drawing air to the fiber draw unit 64. The aspirating air pulls the filaments through the column or passage of fiber draw unit 64 and continues to reduce the diameter of the semi-molten filaments. The fiber draw unit desirably provides a draw ratio of at least about 100/1 and more desirably has a draw ratio of about 450/1 to about 1800/1. The draw ratio refers to the ratio of final velocity of the fully drawn or melt-attenuated filament to the velocity of the filament upon exiting the spin pack. Although a preferred draw ratio is provided above, it will be appreciated by those skilled in the art that the particular draw ratio can vary with the selected capillary size and the desired fiber denier. In a further aspect, the filaments are desirably attenuated with a draw force between about 5 psig and about 15 psig and still more desirably, the partially quenched filaments are desirably drawn with a draw force of between about 6 psig and about 10 psig. In a further aspect, the extruded filaments are melt-attenuated so as to reduce the overall filament diameter by at least about 75% and still more desirably by 90% or more. Although the molten or semi-molten multicomponent filaments experience a significant drawing or "pulling" force, the filaments do not break or degrade in the melt-attenuating process despite the inclusion of one or more high MFR polymeric components. The multicomponent filaments are able to withstand the forces to which they are subjected in the attenuation steps because the low MFR polymeric component, which comprises a major portion of the outer portion of the filament, "skins over" or solidifies to an extent sufficient to provide the necessary integrity to the multicomponent filament. However, the high MFR polymeric component, which comprises at most a minor portion of the outer surface area of the filament, is able to be drawn by relatively high drawing forces and thereby achieve a low denier filament.

An endless foraminous forming surface 68 can be positioned below fiber draw unit 64 to receive continuous attenuated filaments 70 from the outlet opening of fiber draw unit 64. A vacuum is desirably positioned below forming surface 68 in order to help pull the attenuated filaments 70 onto forming surface 68. The deposited fibers or filaments comprise an unbonded, nonwoven web of continuous multicomponent filaments. The web can then, optionally, be lightly bonded or compressed to provide the web with sufficient integrity for handling purposes. As an example, the unbonded web can be lightly bonded using a focused stream of hot air from hot air-knife 74 such as, for example, as described in U.S. Pat. No. 5,707,468. Alternatively, additional integrity can be imparted to the nonwoven web by compaction rollers (not shown) as is known in the art. A durable nonwoven web can be achieved by adding additional integrity to the web structure by more extensively bonding or entangling the same. Desirably, the lightly integrated web is then bonded as desired such as, for example, by thermal point bonding, ultrasonic bonding, through-air bonding, and so forth. In reference to FIG. 4, the lightly bonded nonwoven web is thermally bonded by through-air bonder 76 thereby forming a durable nonwoven web 78 which can be further processed and/or converted as desired.

Multicomponent spunbond fibers of the present invention can have an average fiber diameter between about 5 and 30 microns and still more desirably between about 8 and 15 microns. In a further aspect, the multicomponent spunbond fibers can have a denier between about 0.15 and about 6. In addition, since the fibers are able to undergo significant drawing force and hence experience a substantial degree of attenuation and/or orientation, the multicomponent filaments of the present invention can exhibit good hand, coverage, drape and improved bonding.

In addition, as indicated above, the filaments of the present invention are also suitable for use in other melt-extrusion fiber forming processes. As a further specific example, meltblown fibers and filaments are generally formed by extruding a molten thermoplastic material through a plurality of fine die capillaries as molten threads or filaments into converging high velocity air streams that attenuate the filaments of molten thermoplastic material to reduce their diameter. Thereafter, the meltblown fibers can be carried by the high velocity air stream and are deposited on a collecting surface to form a web of randomly dispersed meltblown fibers. Such a process is disclosed, for example, in U.S. Pat. No. 3,849,241 to Butin et al., U.S. Pat. No. 4,100,324 to Anderson et al., U.S. Pat. No. 5,271,883 to Timmons et al., U.S. Pat. No. 5,652,048 to Haynes et al. U.S. Pat. No. 3,425,091 to Ueda et al.; U.S. Pat. No. 3,981,650 to Page; and U.S. Pat. No. 5,601,851 to Terakawa et al. and in U.S. Naval Research Laboratory Report No. 4364 dated May 25, 1959 by Wente, V. A., Boone, E. L. and Fluharty, C. D. entitled "Manufacture of Superfine Organic Fibers" and U.S. Naval Research Report No. 5265 dated Feb. 11, 1958 by K. D. Lawrence, R. T. Lucas and J. A. Young entitled "An Improved Device For The Formation Of Superfine, Thermoplastic Fibers"; the entirety of each of the aforesaid references are incorporated herein by reference.

While the degree of attenuation is not as high as that experienced in other melt-spinning operations, e.g. spunbond processes, the fibers experience significant reduction in diameter while in a molten and/or semi-molten state. Thus, fiber breaks and/or the formation of "fly" (i.e. loose fibers) can likewise be a problem in meltblown fiber processes. The extruded filaments are desirably attenuated with a draw force between about 3 psig and about 12 psig and still more desirably, the partially quenched filaments are desirably drawn with a draw force of between about 4 psig and about 8 psig. In a further aspect and with respect to meltblowing processes, the extruded filaments are melt-attenuated so as to reduce the overall fiber diameter by at least about 85% and still more desirably by about 95% or more.

The fabrics and nonwoven webs formed from the process of the present invention are well suited for use in a variety of products and/or applications. In addition, the webs and fabrics of the present invention are also well suited for use in laminate or multilayer structures. Thus, webs and fabrics of the present invention can be used alone or in combination with one or more additional layers such as, for example, a film, nonwoven web, woven fabric, foam, scrim and so forth. Exemplary multilayer structures include, but are not limited to, film laminates and laminates of two or more nonwoven layers, e.g. a spunbond/meltblown laminate (SM) or a spunbond/meltblown/spunbond (SMS) laminate. Exemplary multilayer laminates are also described in U.S. Pat. No. 4,041,203 to Brock et al., U.S. Pat. No. 5,188,885 to Timmons et al., U.S. Pat. No. 5,855,999 to McCormack and U.S. Pat. No. 5,817,584 to Singer et al. As but a few examples, the multicomponent filament nonwoven webs of the present invention and laminates thereof are well suited for use as a component in personal care articles, wipers, industrial or medical protective garments, outdoor equipment covers, filter media, infection control products and so forth. As specific examples, the multicomponent filaments and webs of the present invention are well suited for use as an outer cover of a personal diaper or incontinence garment, sterile wrap, face mask media, and so forth.

EXAMPLES

In each of the examples set forth below, multicomponent continuous spunbond filaments were made using an apparatus as generally described in U.S. Pat. No. 3,802,817 to Matsuki et al. The multicomponent fibers formed were bicomponent fibers having a concentric sheath/core configuration and thus the sheath component fully occluded the core component. The fibers had a solid, round cross-section. The continuous spunbond filaments were deposited upon a foraminous surface with the aid of a vacuum and were initially through-air bonded and then thermally point bonded.

Example 1

The sheath component comprised linear low density polyethylene having a MFR of 35 g/10 minutes (6811A polyethylene available from the Dow Chemical Company) and the core component comprised polypropylene having a MFR of 400 g/10 minutes (3445 polypropylene available from Exxon Chemical Company). The ratio of the sheath and core polymeric components was 50:50 (i.e. each polymer component comprised about 50%, by volume, of the fiber). The bicomponent fibers were spun as indicated above and produced an insignificant number of fiber breaks. The draw force upon the fibers was approximately 6 psig and the nonwoven web produced therefrom comprised fibers having an average fiber size of 17.7 micrometers and a denier of approximately 2.

Example 2

The sheath component comprised linear low density polyethylene having a MF-R of 35 g/10 minutes (6811A polyethylene available from the Dow Chemical Company) and the core component comprised polypropylene having a MFR of 400 g/10 minutes (3445 polypropylene available from Exxon Chemical Company). The ratio of the sheath and core polymeric components was 50:50 (i.e. each polymer component comprised about 50%, by volume, of the fiber). The bicomponent fibers were spun as indicated above and produced an insignificant number of fiber breaks. The draw force upon the fibers was approximately 3 psig and the nonwoven web produced therefrom comprised fibers having an average fiber size of 21.6 micrometers and a denier of approximately 2.95.

Example 3

The sheath component comprised linear low density polyethylene having a MFR of 35 g/10 minutes (6811A polyethylene available from the Dow Chemical Company) and the core component comprised polypropylene having a MFR of 400 g/10 minutes (3505 polypropylene available from Exxon Chemical Company). The ratio of the sheath and core polymeric components was 30:70. The bicomponent fibers were spun as indicated above and produced an insignificant number of fiber breaks. The draw force upon the fibers was approximately 6 psig and the nonwoven web produced therefrom comprised fibers having an average fiber size of 16.4 micrometers and a denier of approximately 1.7.

Example 4

The sheath component comprised linear low density polyethylene having a MFR of 35 g/10 minutes (6811A polyethylene available from the Dow Chemical Company) and the core component comprised polypropylene having a MFR of 800 g/10 minutes (PF015 polypropylene available from montell polyolefins). The ratio of the sheath and core polymeric components was 50:50. The bicomponent fibers were spun as indicated above and produced an insignificant number of fiber breaks. The draw force upon the fibers was approximately 6 psig and the nonwoven web produced therefrom comprised fibers having an average fiber size of 16.3 micrometers and a denier of approximately 1.8.

While numerous other patents and/or applications have been referred to in the specification, to the extent there is any conflict or discrepancy between the teachings incorporated by reference and that of the written specification above, the above-written specification shall control. Additionally, while the invention has been described in detail with respect to specific embodiments thereof, and particularly by the example described herein, it will be apparent to those skilled in the art that various alterations, modifications and/or other changes may be made without departing from the spirit and scope of the present invention. It is therefore intended that all such modifications, alterations and other changes be encompassed by the claims.

We claim:

1. A thermoplastic polymer fabric comprising:

a plurality of continuous multicomponent filaments having a denier less than about 3 and comprising a first polymeric component and a second polymeric component wherein said second polymeric component comprises a majority of the outer surface of said multicomponent filament;

said first polymeric component having been made from a first thermoplastic polymer having a melt-flow rate of at least 150 g/10 minutes;

said second polymeric component having been made from a second thermoplastic polymer having a melt-flow rate at least about 65% less than the melt-flow rate of the first thermoplastic polymer.

2. The thermoplastic polymer fabric of claim 1 wherein said second thermoplastic polymer has a melt-flow rate at least about 75% less than the melt-flow rate of the first thermoplastic polymer.

3. The thermoplastic polymer fabric of claim 1 wherein said second thermoplastic polymer has a melt-flow rate at least about 85% less than the melt-flow rate of the first thermoplastic polymer.

4. The thermoplastic polymer fabric of claim 2 wherein said multicomponent filament is a bicomponent filament and has a sheath-core cross-sectional configuration wherein the second polymer comprises the sheath and further wherein the sheath component comprises substantially the entire outer surface of the multicomponent filament.

5. The thermoplastic polymer fabric of claim 2 wherein said multi component filament has a striped cross-sectional configuration wherein the first polymer component is positioned between said second polymeric component and a third polymeric component; said third polymeric component comprises a polymer having a melt-flow rate similar to that of said second polymer.

6. The thermoplastic polymer fabric of claim 2 wherein said first polymer comprises a propylene polymer and said second polymer comprises an ethylene polymer.

7. The thermoplastic polymer fabric of claim 2 wherein said first polymer comprises a propylene polymer and said second polymer comprises a propylene polymer.

8. The thermoplastic polymer fabric of claim 1 wherein said first polymer comprises a first olefin polymer having a melt-flow greater than 200 g/10 minutes and wherein said second polymer comprises an olefin polymer having a melt-flow rate less than about 50 g/10 minutes.

9. The thermoplastic polymer fabric of claim 8 wherein said thermoplastic polymer fabric comprises spunbond fibers.

10. A thermoplastic polymer fabric comprising:

a plurality of continuous multicomponent filaments having a denier less than about 3 and comprising a first polymeric component and a second polymeric component wherein said second polymeric component comprises a majority of the outer surface of said multicomponent filament;

said first polymeric component having been made from a first thermoplastic polymer having a melt-flow rate of at least 150 g/10 minutes;

said second polymeric component having been made from a second thermoplastic polymer having a melt-flow rate at least about 65% less than the melt-flow rate of the first thermoplastic polymer.

11. The thermoplastic polymer fabric of claim 3 wherein said first component comprises an olefin polymer and said second polymer is selected from the group consisting of polyesters and polyamides.

* * * * *

UNITED STATES PATENT AND TRADEMARK OFFICE

CERTIFICATE OF CORRECTION

PATENT NO. : 6,878,650 B2
APPLICATION NO. : 09/742830
DATED : April 12, 2005
INVENTOR(S) : Darryl Franklin Clark et al.

It is certified that error appears in the above-identified patent and that said Letters Patent is hereby corrected as shown below:

Col. 12 lines 26-40

--delete Claim 21--

21. (Previously presented): A thermoplastic polymer fabric comprising:

a plurality of continuous multicomponent filaments having a denier less than about 3 and comprising a first polymeric component and a second polymeric component wherein said second polymeric component comprises a majority of the outer surface of said multicomponent filament;

said first polymeric component having been made from a first thermoplastic polymer having a melt-flow rate of at least 150 g/10 minutes;

said second polymeric component having been made from a second thermoplastic polymer having a melt-flow rate at least about 65% less than the melt-flow rate of the first thermoplastic polymer.

--Rename Claim 22 to Claim 21--

22. (New) The thermoplastic polymer fabric of claim 3 wherein said first component

UNITED STATES PATENT AND TRADEMARK OFFICE

CERTIFICATE OF CORRECTION

PATENT NO. : 6,878,650 B2
APPLICATION NO. : 09/742830
DATED : April 12, 2005
INVENTOR(S) : Darryl Franklin Clark et al.

It is certified that error appears in the above-identified patent and that said Letters Patent is hereby corrected as shown below:

comprises an olefin polymer and said second polymer is selected from the group consisting of polyesters and polyamides.

Signed and Sealed this

Twenty-second Day of January, 2008

JON W. DUDAS
*Director of the United States Patent and Trademark Office*